US005393223A

United States Patent [19]

Goerde et al.

[11] Patent Number: 5,393,223

[45] Date of Patent: Feb. 28, 1995

[54] CUTTING TORCH MACHINE HAVING AN INTERNAL IGNITION DEVICE

[75] Inventors: Werner Goerde, Fulda; Manfred Greifzu, Kuenzell, both of Germany

[73] Assignee: GCE-Rhoena Autogengeraete GmbH, Fulda, Germany

[21] Appl. No.: 83,462

[22] Filed: Jun. 30, 1993

[30] Foreign Application Priority Data

Dec. 28, 1992 [EP] European Pat. Off. ..... 92122076

[51] Int. Cl.[6] ..... F23Q 7/06

[52] U.S. Cl. ..... 431/258; 431/261

[58] Field of Search ..... 431/258, 266, 264

[56] References Cited

U.S. PATENT DOCUMENTS 2,127,723 8/1938 Fausek et al. ..... 431/266

FOREIGN PATENT DOCUMENTS 3941370 6/1991 Germany .

*Primary Examiner*—Carroll B. Dority

*Attorney, Agent, or Firm*—Oblon, Spivak, McClelland, Maier & Neustadt

[57] ABSTRACT

In a cutting torch machine having an internal ignition device on a cutting oxygen channel which is in communication with an ignition gas generating mixing stage, the mixing stage can be connected via a controlling heating oxygen pressure reducer and at least one heating oxygen solenoid valve to a heating oxygen source and via a fuel gas solenoid valve to a fuel gas duct. The cutting torch machine includes, on a valve body, connecting nipples for fuel gas, for heating oxygen and for cutting oxygen. Preferably, a heating gas injector is provided within the valve body. In order to increase operation safety, the mixing stage (injector), heating oxygen pressure reducer and solenoid valves are disposed within the valve body, and the mixing stage is connected via the fuel gas solenoid valve to the connecting nipple for fuel gas and via the heating oxygen pressure reducer and the heating oxygen solenoid valve to the connecting nipple for heating oxygen.

7 Claims, 3 Drawing Sheets

CUTTING TORCH MACHINE HAVING AN INTERNAL IGNITION DEVICE

BACKGROUND OF THE INVENTION

1. Field of the Invention

The present invention relates to a cutting torch machine having an internal ignition device on a cutting oxygen channel in communication with a mixing stage which generates an ignition gas.

2. Discussion of the Related Art

In conventional cutting torch machines having a cutting oxygen channel, the feeders, i.e., the ducts, are provided on threaded pipe connections for fuel gas and/or heating oxygen, which are connected with a fuel gas and oxygen source. The conventional cutting torch additionally includes a separate adapter nipple leading to a fuel gas-oxygen mixture feeder which leads to the cutting oxygen channel. The fuel gas-oxygen mixture constitutes the ignition gas. At the cutter oxygen channel, an electrical ignition device is provided downstream of the mouth of the fuel gas-oxygen mixture feeder. The fuel gas-oxygen mixture is generated outside of the torch body in a mixing stage designed as an injector. The injector constitutes part of an ignition gas volume control device directly connected to the supply sources for fuel gas and heating oxygen. This should safeguard that an ignition gas volume is fed to the ignition point which is independent from, and uninfluenced by, the adjustment of the fuel gases of the cutting torch (German Offenlegungsschrift No. 35 27 955).

In the branching-off ducts to the injector conducting heating oxygen and fuel gas, the ignition gas volume control device referred to includes a solenoid valve and a pressure control each. In detail, the pressure control is connected via a connecting T piece to a heating oxygen supply source or a fuel gas supply source. Via a threaded adapter, a cutting oxygen duct is further provided on the cutter torch, which is connected via a control and/or regulating device to the cutting oxygen supply source. This means that the supply of the fuel gas-oxygen mixture as the ignition gas is provided simultaneously with the supply of the fuel gas, the heating oxygen and the cutter oxygen to the cutting torch. A special duct is provided for the ignition gas which in practice is designed as a hose. While such hoses are suitable for the supply of ignition gas or fuel gas, the risk of an accident cannot be excluded if the ignition gas, or the fuel gas mixture, respectively, is supplied via the usually long paths. The effort in providing all the gadgets and devices is substantial.

In the conventional system of the separate ignition gas volume control device wherein also the ignition gas is generated and which, to this end, substantially includes the mixer for mixing the ignition fuel gas and the ignition oxygen to obtain the ignition gas mixture, pressure control for the ignition oxygen and the ignition gas, solenoid valves for switching on and off the ignition fuel gas and the ignition oxygen, provided in parallel to the fuel gas and heating oxygen supply and cutting oxygen supply at the cutting torch, the problem arises with a view to the greater volume and/or the higher pressure of the latter fuel gas and heating oxygen supply, that the ignition gas mixture flowing at a lower volume and under a smaller pressure will arrive relatively late at the cutter jet.

This is particularly cumbersome in case of cutting torch machines having a plurality of cutting torches since the igniting spark can be generated only depending on the last available volume of the ignition gas mixture of one torch (German Patent Specification No. 3,827,750). In order to reduce the ignition time and to obtain safe ignition, the prior art control and regulation means for ignition gases is so designed that the ignition gas mixture flows to the cutting torch in a larger volume and/or greater pressure relative to the required volume, or the required pressure, respectively, and is adjusted to the required volume, or the required pressure, by a control or regulating means provided near the cutting torch or within the cutting torch. The control or regulating means can in this case be designed as a precision dispensing valve. It can also be provided as a diaphragm having a dispensing bore. At the entrance before the mixer in the fuel gas duct furthermore, a precision dispensing valve for optimizing the fuel gas volume can be provided, whereby at the entrance before the precision dispensing valve, at least one solenoid valve is arranged. The precision dispensing valve may include adjusting means which may be adjusted by control means in response to a predetermined mixing ratio or a predetermined volume of the ignition gas mixture. The basic disadvantages of the ignition gas mixture supply to the cutting torch in parallel to the fuel gas and heating oxygen as well as cutting oxygen have not, however, been solved.

SUMMARY OF THE INVENTION

The present invention provides for a novel cutting torch machine having an internal ignition device of the kind referred to in the beginning in a way which will avoid the use of the numerous devices and gadgets for the complete system and increase operation safety.

In the present invention, the mixing of the ignition gas is not performed before the torch but rather within the valve body of the torch body whereby the ignition gas, regardless of the different entrance pressures of the torch, is controlled by the controlling pressure reducer for the heating oxygen integrated in the torch body. This measure avoids the disadvantages that can otherwise be experienced when feeding the heating oxygen used for the cutting and for the igniting. The cutting torch includes therefore only connecting nipples for the fuel gas, for the heating oxygen and for the cutting oxygen; there is no connection for the ignition gas. One hose by which the ignition gas is fed to the cutting torch machine can therefore be dispensed with. The cutting torch machine as a device, becomes therefore relatively simple, but is nevertheless safe in operation. By providing the mixing stage and the heating oxygen pressure control within the cutting torch machine, it is also obtained that the ignition gas generated in spite of the relatively low pressure and/or low volume will rapidly arrive in the cutting oxygen channel which constitutes a component of the cutting torch machine. Since also the solenoid valves are provided within the cutting torch machine, not only the mixing process but also the control of the ignition process can proceed within the cutting torch machine. Since the components referred to are provided within the cutting torch machine, a high protection against damages is obtained.

A particular rigidity and compactness of the cutting torch machine is obtained if the mixing stage and the heating oxygen pressure reducer constitute integral components of the cutting torch machine.

In this case, instead of the heating oxygen pressure reducer, at least one diaphragm is preferably provided which includes a dispensing opening and is less complicated.

In a preferred alternative embodiment, the cutting torch machine is characterized in that an injector as the ignition gas mixing stage, a heating oxygen pressure reducing diaphragm and a fuel gas pressure reducing diaphragm constitute integral components of the valve body, that at least parts of the solenoid valves are provided within the valve body and that the injector, via the fuel gas pressure reducing diaphragm and the fuel gas solenoid valve, is in communication with the connecting nipple for fuel gas and via the heating oxygen pressure reducing diaphragm and the heating oxygen solenoid valve with the connecting nipple for heating oxygen.

With a view to the simple internal structure of the valve body, this cutting torch machine is particularly simple as a device. The mixing space for the ignition gas in the valve body is essentially formed by a bore. Of particular advantage are the connections connecting the injector for the ignition gas via the fuel gas pressure reducing diaphragm and the fuel gas solenoid valve to the connecting nipple for the fuel gas and via the heating oxygen pressure reducing diaphragm and the heating oxygen solenoid valve to the connecting nipple for the heating oxygen, each provided as (stub) bores in the valve body. By this, the compactness and the simple structure of the valve body are further promoted.

A more precise control can be obtained by means of a parallel arrangement of three diaphragms each of which are preceded by a solenoid valve in order to preselect, by CNC control, the diaphragms, individually or commonly, in response to the cutting problem.

For the adjustment of the fuel gas pressure at the mixing stage, the present invention includes a needle valve in the cutting torch machine provided between the mixing stage and the connecting nipple for the fuel gas.

The supply of the ignition gas mixture to the cutting oxygen channel of the cutting torch machine and the ignition by electrical ignition means is conventional. Preferably, glow plugs are used which are normally employed in model airplane construction and which are therefore easily available at reasonable cost.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
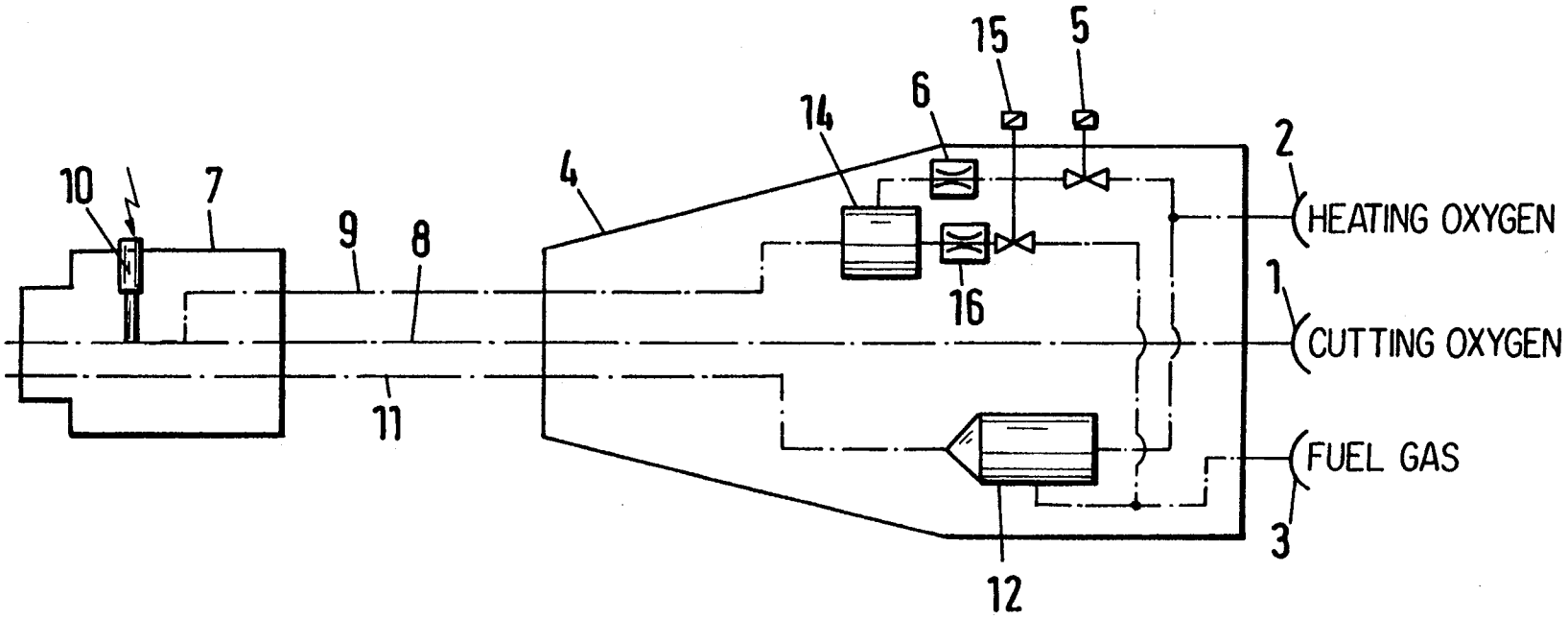
FIGS. 1, 2 and 3 are schematic views of the cutting torch machine of the present invention.
Figure 2:
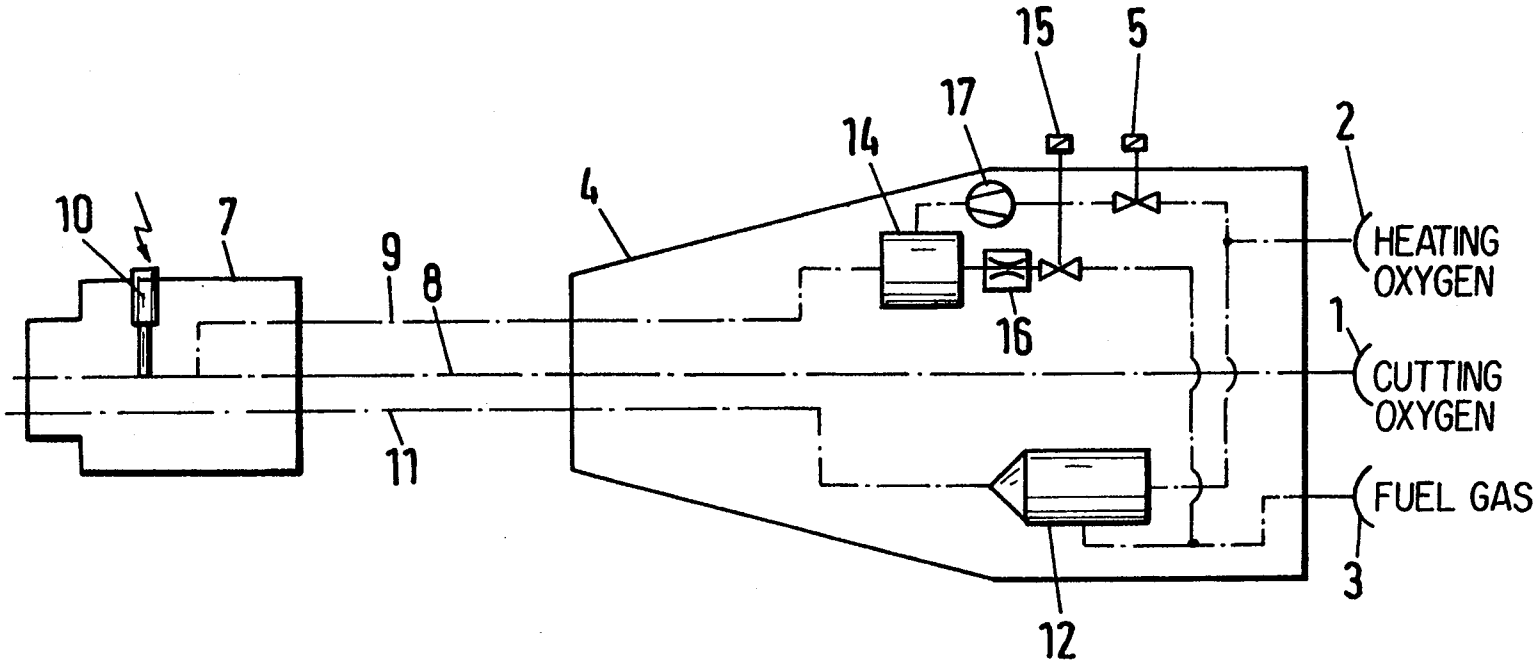
Figure 3:
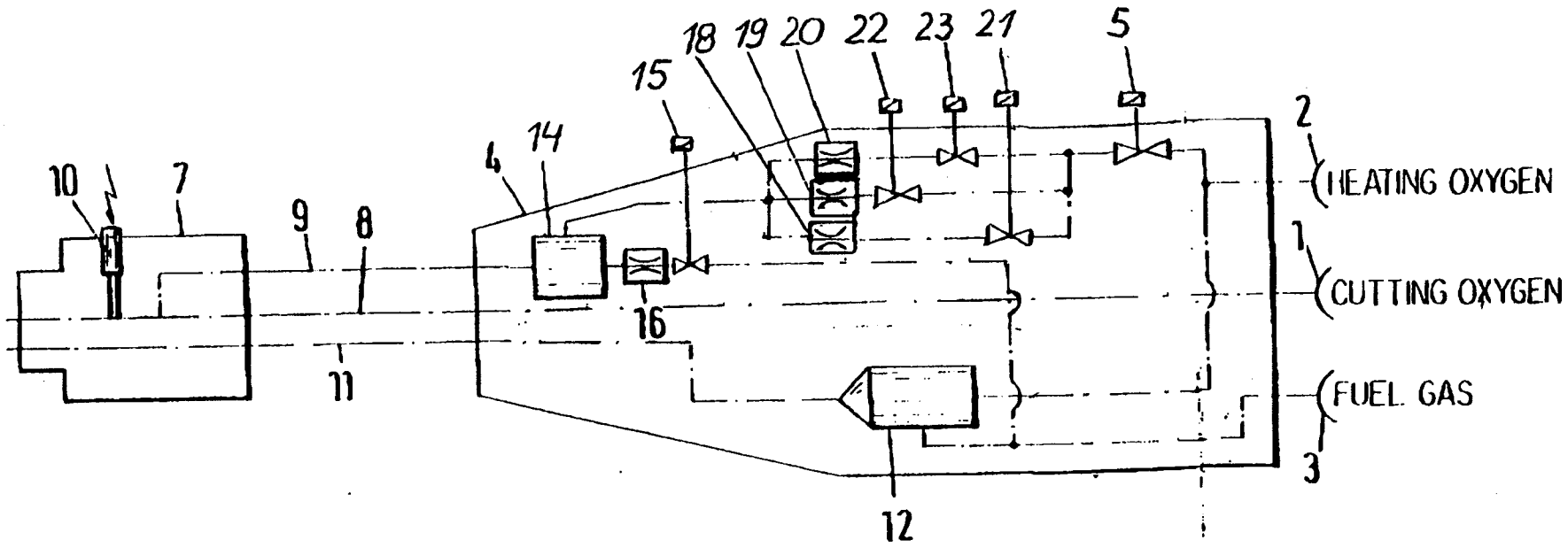

Referring now to the drawings, wherein like reference numerals designate identical or corresponding parts throughout the several views, in FIGS. 1, 2 and 3 the numerals 1, 2 and 3 refer to the connecting nipples for cutting oxygen, heating oxygen and fuel gas, the nipples being provided on valve body 4. The cutting tool machine further includes a torch head 7 which may be connected with a duct (not shown) to the valve body 4 and into which a cutting oxygen channel 8 leads. An ignition gas bore 9 for the ignition gas supply leads to the cutting oxygen channel. Downstream of the entrance spot of the ignition gas bore, a model construction glow plug 10 is connected to the cutting oxygen channel 8. A fuel gas-heating oxygen mixture supply in torch head 7 of the cutting torch machine is shown at line 11. It starts from heating gas injector 12 also disposed within the valve body 4. The heating gas injector 12 mixes the fuel gas and heating oxygen and supplies the mixture to line 11. A needle valve (not shown on the drawing) in the valve body may be provided in one feeder of the fuel gas to injector 12 to control the heating flame.

Integrally with the valve body 4, injector 14 is provided wherein the ignition gas is mixed and which is, therefore, referred to as the mixing means for the ignition gas. In order to supply injector 14 for the ignition gas mixture formation with heating oxygen, the latter is branched off from the heating oxygen supply and is fed, via a solenoid valve 5 and a diaphragm 6 having dispensing openings leading to injector 14. The diaphragm 6 regulates the flow into injector 14. A system including three diaphragms having dispensing openings may be provided which are preselected by solenoid valves by means of a CNC control. A supply of the fuel gas to injector 14 is realized via a solenoid valve 15 and a diaphragm or a needle valve 16 having a fixed adjustment.

The above-referenced elements of the cutting torch machine, with the exception of the external portions of connecting nipples 1, 2, 3 and, perhaps, some external parts of solenoid valves 5, 15 are provided within the valve body of the cutting torch machine whereby, in particular, injector 14 for ignition gas mixing and diaphragms 6 and 16, constitute integral components of valve body 4. Remaining (stub) lines in the valve body are indicated by dash-dotted lines. Thus, all connections can be taken from the drawing.

The embodiment of the cutting torch machine according to FIG. 2 differs from that according to FIG. 1 as concerns heating oxygen supply 2 for ignition mixture formation. Instead of one, or a plurality of, parallel diaphragms as in FIG. 1, a pressure reducer 17 instead of a diaphragm is inserted in the heating oxygen supply in FIG. 2 which controls the heating oxygen pressure in injector 14 independently from variations of the heating oxygen pressure at connecting nipples 2. FIG. 3 shows an arrangement in which three diaphragms 18, 19 and 20 are disposed in parallel and lead to the injector 14. The diaphragms 18, 19 and 20 are positioned on the line leading from the connecting nipple 2 for heating oxygen. Additionally, the diaphragm 18 is provided with a solenoid valve 21, the diaphragm 19 is provided with a solenoid valve 22 and the diaphragm 20 is provided with a solenoid valve 23.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A cutting torch machine comprising:

a valve body having a first connecting nipple for fuel gas, a second connecting nipple for heating oxygen, and a third connecting nipple for cutting oxygen;

an internal ignition device on a cutting oxygen channel, the cutting oxygen channel being connected to said third connecting nipple for cutting oxygen;

a mixing means positioned in said valve body for generating an ignition gas and communicating said ignition gas with said cutting oxygen channel;

a controlling heating oxygen pressure reducer and at least one heating oxygen solenoid valve positioned within said valve body and connecting said mixing means to said second connecting nipple for heating oxygen;

a fuel gas solenoid valve positioned within said valve body and connecting said mixing means to said first connecting nipple for fuel gas; and a fuel gas injector provided within said valve body.

2. A cutting torch machine according to claim 1, wherein said fuel gas injector is connected to said first connecting nipple for fuel gas and said second connecting nipple for heating oxygen.

3. A cutting torch machine comprising:

a valve body having a first connecting nipple for fuel gas, a second connecting nipple for heating oxygen, and a third connecting nipple for cutting oxygen;

an internal ignition device on a cutting oxygen channel, the cutting oxygen channel being connected to said third connecting nipple for cutting oxygen;

an ignition gas mixing means positioned in said valve body for generating an ignition gas and communicating said ignition gas with said cutting oxygen channel;

at least one heating oxygen diaphragm and at least one heating oxygen solenoid which connect said mixing means to said second connecting nipple for heating oxygen, wherein said heating oxygen diaphragm and at least a part of said heating oxygen solenoid are positioned within said valve body; and a fuel gas pressure reducing diaphragm and a fuel gas solenoid valve which connect said mixing means to said first connecting nipple for fuel gas, wherein said fuel gas pressure reducing diaphragm and at least a part of said fuel gas solenoid valve are positioned within said valve body.

4. A cutting torch machine according to claim 3, wherein said valve body comprises bores, said first, second and third connecting nipples being connected to said valve body through said bores.

5. The cutting torch machine according to claim 3, wherein said mixing means, said heating oxygen diaphragm and said fuel gas pressure reducing diaphragm comprise integral components of said valve body.

6. The cutting torch machine according to claim 3, wherein three of said heating oxygen diaphragms are disposed in parallel to the flow direction, each of said heating oxygen diaphragms being preceded by a solenoid valve.

7. A cutting torch machine according to one of claims 1 or 3, wherein said internal ignition device is a model-constructor glow plug which is provided in a torch head.

* * * * *